US005603426A

United States Patent [19]

Krzywdziak et al.

[11] Patent Number: 5,603,426

[45] Date of Patent: Feb. 18, 1997

[54] STIRRER LID FOR COLOR CANS ON PAINT STIRRING MACHINES AND METHOD OF MANUFACTURING THESE LIDS

[75] Inventors: Alain Krzywdziak, Orleans; Daniel Parmenon, Orleans La Source, both of France

[73] Assignee: F.A.S., Orleans Cedex 2, France

[21] Appl. No.: 328,457

[22] Filed: Oct. 25, 1994

[30] Foreign Application Priority Data

Oct. 25, 1993 [FR] France ..... 93 12687

[51] Int. Cl.[6] ..... B65D 45/16

[52] U.S. Cl. ..... 220/324; 220/315; 220/700

[58] Field of Search ..... 220/315, 324, 220/327, 328, 695, 699, 700, 701, 702, 354

[56] References Cited

U.S. PATENT DOCUMENTS

| | | | |
|---|---|---|---|
| 1,089,066 | 3/1914 | Meyer | 220/354 X |
| 1,212,878 | 1/1917 | Augenbraun | 220/324 X |
| 2,263,842 | 11/1941 | Gross | 220/324 |
| 2,263,843 | 11/1941 | Gross | 220/324 X |
| 3,469,735 | 9/1969 | Burt | 220/701 X |
| 4,279,358 | 7/1981 | Jacobs | 220/321 |
| 5,181,626 | 1/1993 | Daenen et al. | 220/282 |
| 5,221,020 | 6/1993 | Brimo, II | 220/357 |
| 5,335,806 | 8/1994 | Dedoes | 220/358 |

*Primary Examiner*—Stephen Cronin

*Attorney, Agent, or Firm*—Scully, Scott, Murphy & Presser

[57] ABSTRACT

A stirrer lid for color cans on stirring machines, of the type having at a base thereof a frustoconical closure edge, having a main body (5), and including an annular ring (7) fastened to the base of the body and of being downward tapering frustoconical cross section with the ring (7) forming the closure edge of the lid.

4 Claims, 1 Drawing Sheet

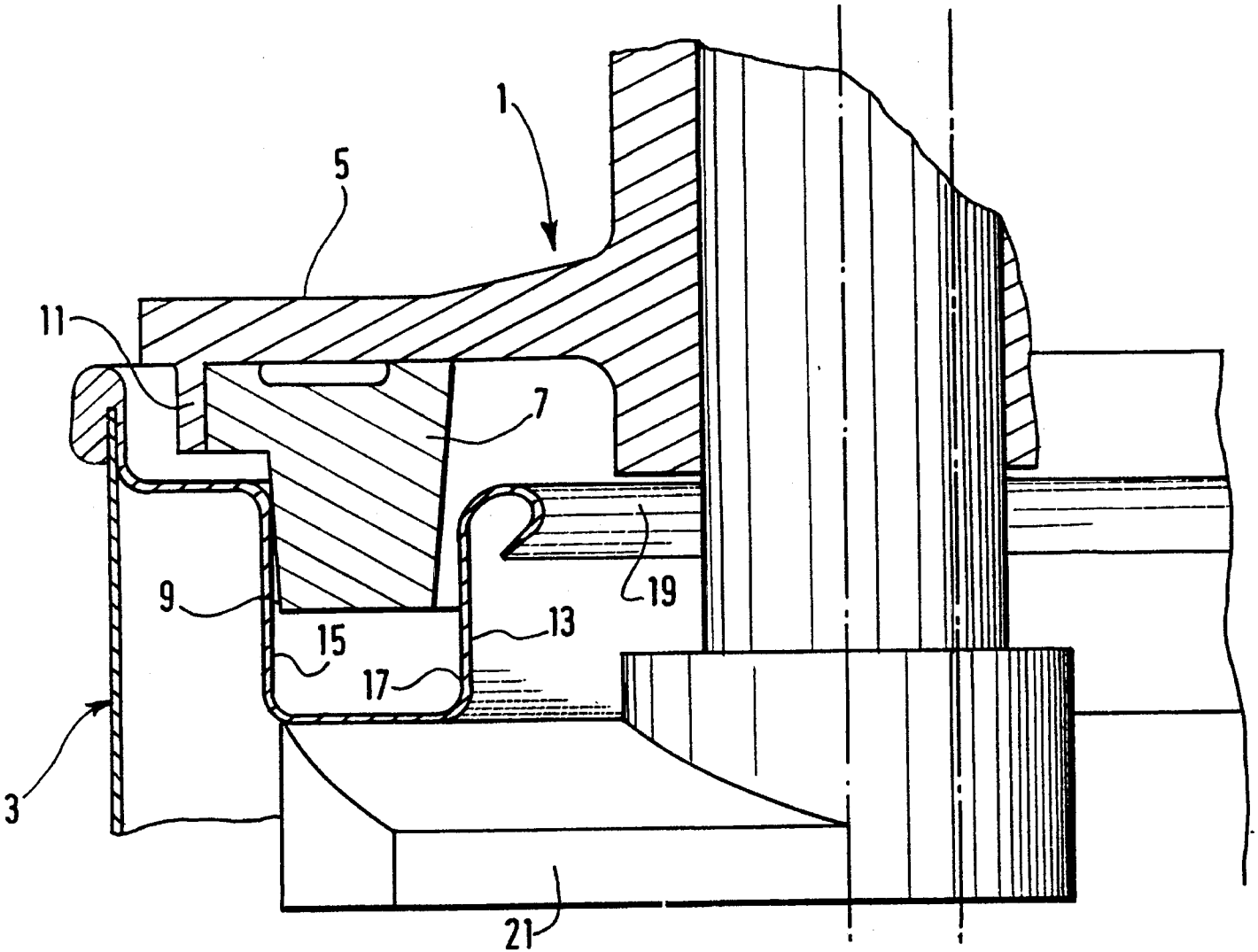
1
5
7
9
11
13
15
17
19
21
3

STIRRER LID FOR COLOR CANS ON PAINT STIRRING MACHINES AND METHOD OF MANUFACTURING THESE LIDS

BACKGROUND OF THE INVENTION

1. Field of the Invention

The present invention relates to stirrer lids for color cans equipping paint stirring machines and, in particular, to a stirrer lid of the type comprising, at its base, a frustoconical annular closure edge intended to be tightly applied against the corresponding upper opening rim of the color cans and which can be easily adaptable, for closing, to the various existing color cans which vary slightly in shape from one constructor to another. It also relates to the method of manufacturing these lids.

2. Discussion of the Prior Art

It is known that stirrer lids of this type permit automatic self-centering on the receiving color cans, that they make it possible to compensate for defects of the rim of the can, the possible oval of the rim, for example, by the wedging effect on closing and, finally, that they provide a rigid closure which is permanent over time and insensitive to the stirring vibrations, in contradistinction and to lids with a flexible seal device.

These stirrer lids are particularly suitable for the stirring of color cans mounted so as to be suspended from the stirring machines, but they may also be fitted onto machines with standing cans. They are cast in a single piece from a metal alloy, preferably Zamak, the frustoconical closure rim forming an integral part of the body of the lid. However, the dimensions of the opening edge of the cans, for a defined can capacity range (1, 3, 5 liters) vary slightly depending on their origin. The diameter of the opening edge of the cans may vary for the same capacity range, by 5%, from one constructor to another. Of course, it is possible to vary the depth to which the frustoconical rim of the lid is pressed onto the edge of the can, being applied against one or other of the inner and outer flanges of the annular rim of the collar bearing the closure edge of the can, or against its peripheral terminal shoulder, but these various possibilities permit only limited closure adaptation to the various paint cans existing on the market.

Adaptation of this type of lid to a defined series of color cans thus requires generally the production of a specific lid whose frustoconical rim is adjusted to the particular opening edge of said series. This production consequently requires the complete casting of a series of lids adapted to said series of cans. A change of mold, from one series to another, requires a relatively lengthy operation time (several hours) due to the extensive handling of the masses involved (several hundreds of Kg) for the lid mold and its heating to temperature and temperature stabilization before casting.

SUMMARY OF THE INVENTION

The invention aims to overcome these drawbacks by proposing a stirrer lid, of the type with a frustoconical edge, which is adaptable to the various existing color cans, within a given capacity range, and the method of manufacture of which requires an appreciably shorter production time, especially for casting, from one manufacturing series to another.

The stirrer lid according to the invention is characterized in fact in that it comprises a main body and an annular ring of frustoconical cross section fixed coaxially with said body to its base.

This ring forms the frustoconical rim of the lid. It is made of metal alloy and has a hardness and a mechanical strength which are suitable for providing the wedging closure on the opening edge of the cans. The closure pressure may be provided in a conventional manner by fastening cams integral with the body of the lid and engaged beneath the collar of the opening edge of the cans, or by arches integral with the can and engaged on the lid. Its shape may vary in order to be adapted to the opening edge of the various color cans. The main body of the lid remains unchanged for a range of cans of given capacity.

It may be fastened to the lid by crimping by means of lower steps integral with the body of the lid and, preferably, by an annular collar applied against its entire outer periphery.

It may also be riveted to the body of the lid.

This ring may be made by machining but it is advantageously cast with the body of the lid, unitarily according to a casting cycle for a lid, the mold cavity for the ring and the mold cavity for the body of the lid being supplied simultaneously with the same material (Zamak).

After casting, the ring is then assembled with the body of the lid and preferably crimped by said annular collar integral with the body, this being performed by means of a suitable press.

The result of this is that passing from the manufacture of one series of lids to another (adapted to the corresponding series of color cans) requires only a change of mold cavity for the ring, and not a complete change of the mold for the lid as in the current state of the art. Changing the cavity for the ring requires less handling relative to that for the complete mold and the heating and temperature-stabilizing time is considerably shortened. The saving in time when passing from one manufacturing series to another is of the order of several hours.

BRIEF DESCRIPTION OF THE DRAWING

An illustrative embodiment of the invention is now described with reference to the appended drawing, in which:

The single FIGURE is a partial axial cross sectional view of a stirrer lid according to the invention.

DETAILED DESCRIPTION OF A PREFERRED EMBODIMENT

In the drawing, only the edges of the lid 1 and of the corresponding receiving can 3 are depicted. The body 5 of the lid is conventional, having a spherical-cap general shape comprising a built-in pouring lip as well as a bush for the axial passage of the stirrer spindle, (these not being depicted). A short distance from its circular peripheral edge and on its base, it includes an annular ring 7, the useful lower part 9 of which has a downward tapering frustoconical cross section. This ring is crimped to the body 5 of the lid by means of an outer annular collar 11 provided on the base of the body and formed coaxially with the latter. This collar is applied against the front face of the ring. It is oriented slightly inward relative to the vertical so as to lock the assembly, preventing any retraction movement.

When closing the underlying color can, as indicated in the figure, the lid is applied by pressing on the opening rim 13 of the can. The ring is then wedged by its frustoconical lower face 9 against the annular opening rim fold of the can. The wedging is depicted in the case of the figure on the outer face 15 of the annular opening rim of the can. However, closure, and therefore wedging, may take place on the inner opposite face 17 and, possibly, on the annular terminal opening shoulder 19. The shape of the ring for a given can, in relation to the outside dimensions of the body of the lid, takes into account these three closure application possibilities. Moreover, the variable extent to which the ring is pressed in (downward vertical movement) is varied in order to compensate for the slight dimensional variations of the application faces depending on the various cans to be equipped. Pressure of the lid against the can is applied in a conventional manner by means of cams 21 which are integral with the body, at a short distance from its periphery,.and are engaged beneath the rim 13 of the can. These cams, uniformly distributed at the periphery of the body, provide uniform pressure application of the lid against the can.

As previously, the ring and the body of the lid are cast from the same metallic material, preferably Zamak. The mold fashioned for a given manufacturing series comprises a cavity for the body of the lid and a cavity for the ring. The cavity for the body does not change within a given capacity range (1, 3 and 5 liters). Only the cavity for the ring changes as a function of the various manufacturing series of the lids in relation to the cans to be equipped. The cavity for the body and the cavity for the ring are supplied simultaneously with casting material and, as soon as the body and ring castings have been produced, they are conveyed to a press tool in which the annular collar 11 for crimping the ring is pushed back by a press stroke against the circular front face of the ring, positioned beforehand on the base of the body of the lid. The ring is then completely integral with the body of the lid.

It will be further noted, by way of a variant, that the ring according to the invention may, possibly, serve as a support for a closure seal interposed between this ring and the can rim, this seal being received in a suitable housing, for example a groove formed in the ring, it being possible for the seal to vary depending on the shape of the cans.

We claim:

1. A stirrer lid for a color can arrangeable on stirring machines, said stirrer lid having a base surface possessing a depending frustoconical closure edge shaped to conform with a corresponding opening edge of the can, said stirrer lid comprising a main body (5); an annular ring (7) permanently fastened to the base surface of the body, said annular ring having a downward tapering frustoconical cross-section to provide said closure edge for wedgingly sealing said lid to said can upon mounting thereof on the can, said ring (7) being made of metal alloy and having a mechanical hardness and strength for providing said wedging seal on an opening edge (13) of the can, and fastening cams (21) connected to the body of the lid and being engageable beneath the opening edge (13) of the cans for imparting a closure pressure between said lid and said can.

2. The stirrer lid according to claim 1, wherein the cross-sectional shape of the annular ring (7) is correlated with the opening edge (13) of a can for a specific range in the capacity of the can.

3. The stirrer lid according to claim 1, wherein said annular ring (7) is fastened to the lid by an annular collar (11) depending from said base surface and contacting against the outer periphery of said annular ring.

4. The stirrer lid according to claim 1, wherein said annular ring (7) is machined.

* * * * *